US007845048B1

(12) United States Patent
Bailey et al.

(10) Patent No.: US 7,845,048 B1
(45) Date of Patent: Dec. 7, 2010

(54) PORTABLE AIR-BLOWER FOR REMOVING DEBRIS AND THE LIKE FROM A PUTTING GREEN SURFACE

(76) Inventors: Gerald Bailey, 43227 Kelly Ter., South Riding, VA (US) 20152; Larry D. Bridges, 10218 Provincetown Ct., Fairfax, VA (US) 22032

( * ) Notice: Subject to any disclaimer, the term of this patent is extended or adjusted under 35 U.S.C. 154(b) by 1398 days.

(21) Appl. No.: 11/157,047

(22) Filed: Jun. 21, 2005

(51) Int. Cl.
*A47L 5/14* (2006.01)

(52) U.S. Cl. ..... 15/405; 15/327.5; 15/344; 15/419

(58) Field of Classification Search ..... 15/327.5, 15/344, 345, 405, 410, 415.1–422.1; *A47L 5/14*
See application file for complete search history.

(56) References Cited

U.S. PATENT DOCUMENTS 3,999,243 A * 12/1976 La Pour ..... 15/344
4,097,722 A * 6/1978 Soler et al. ..... 392/385
4,288,886 A * 9/1981 Siegler ..... 15/330
D279,319 S 6/1985 McCloskey
4,734,017 A 3/1988 Levin
4,884,314 A 12/1989 Miner et al.
4,945,604 A 8/1990 Miner et al.
5,257,913 A * 11/1993 Schwarzer et al. ..... 417/411
5,407,135 A 4/1995 Jeffs
5,652,995 A * 8/1997 Henke et al. ..... 15/344
5,950,276 A * 9/1999 Everts et al. ..... 15/405
6,092,260 A 7/2000 Kai
6,125,503 A * 10/2000 Callahan ..... 15/414
6,305,048 B1 * 10/2001 Salisian ..... 15/326
2006/0102199 A1 * 5/2006 Vives-Martinez ..... 134/6

* cited by examiner

*Primary Examiner*—David A Redding

(57) ABSTRACT

An air-blower includes a housing formed from non-corrosive material and is sized for being transportable. The housing has a cavity concentrically centered about its axis, and has an open distal end in fluid communication with the cavity and a closed proximal end. A conduit is conjoined to the housing and provided with proximal and distal ends. The conduit is telescopically adjustable. A mechanism is included for discharging a volume of air away from the conduit. A power supply source is coupled to the discharging mechanism and is contained within the housing, and includes a rechargeable battery pack. The power supply source includes first and second power cords connectable to the battery pack for recharging the battery pack from a cigarette lighter or an electrical wall outlet. A quick-release fastener is connected to the proximal end of the housing for attaching the air-blower to a belt region of one's pants.

3 Claims, 4 Drawing Sheets

PORTABLE AIR-BLOWER FOR REMOVING DEBRIS AND THE LIKE FROM A PUTTING GREEN SURFACE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to portable air blowers and, more particularly, to a portable air-blower for removing debris and the like from a putting green surface.

2. Prior Art

Air blowers are useful in numerous situations such as for drying a surface before applying a paint or adhesive, for cleaning an object, fanning the body, for drying hair, or for supplying air to a fire in a charcoal grill or a fireplace. For such applications, a light, portable and self powered hand-held blower is extremely useful. Another situation where a portable air blower may be quite useful is in the event that a golfer needs to clear the putting green of loose debris that can possibly impede the travel of their golf ball. As a rule in golf, objects such as leaves, grass clippings, sand, etc. are defined as loose impediments, and can only be removed from the golfer's line on a putting green provided he/she does not press down in the green.

Due to the nature of golf and the surroundings it is played in, a blower that can operate independent of the availability of an electric power supply will be more useful in this situation than a blower which is constrained by the availability of electric outlets. Providing a blower with a rechargeable power supply makes such operation possible. However, if the rechargeable power supply is unduly large, the air blower becomes unwieldy and the benefits of it being portable are lost.

In order for an air blower to be useful as a portable tool, it is important that the blower provide an air stream that can impact a surface one to three feet from the outlet of the blower. Further, it is preferred that the blower be capable of providing such an air stream over an extended period without frequent recharging. If such a blower can operate in excess of four hours on a single charge, the blower will be more useful to its operator, especially during golfing activities that tend to last for many hours. To achieve such an air stream over an extended period with a compact hand-held blower, it is important that blower turbulence be minimized. By decreasing air turbulence in the blower, a powerful air stream can be provided for an extended period without requiring the use of an excessively large or heavy rechargeable power supply.

Accordingly, a need remains for a portable air-blower for removing debris and the like from a putting green surface. The present invention satisfies such a need by providing a portable air-blower that is convenient and easy to use, and provides the user with considerable time savings. Such a device provides a light, compact blower that makes it quick and easy to remove loose impediments. The battery powered motor directs a stream of air out of the nozzle with sufficient velocity to move small and light objects, such as leaves and grains of sand. This is advantageously quicker than attempting to pick up or brush away such debris, as is now the common practice even among professional golfers. Thus, the golfer wastes less time clearing a path to the hole, and his/her shot is not adversely affected by losing focus during the cleaning process.

BRIEF SUMMARY OF THE INVENTION

In view of the foregoing background, it is therefore an object of the present invention to provide a portable air-blower for removing debris and the like from a putting green surface. These and other objects, features, and advantages of the invention are provided by a light-weight air-blower for use on a putting green such that a golfer can remove sand, leaves, grass clippings and other loose impediments during putting procedures.

The air-blower includes a cylindrical housing formed from non-corrosive material and suitably sized for being conveniently transported during a round a golf. Such a housing has a centrally registered longitudinal axis and a cavity concentrically centered about the axis. The housing further has an open distal end portion in fluid communication with the cavity and a closed proximal end portion.

A tubular conduit is directly conjoined to the housing and provided with proximal and distal end portions oppositely registered along the longitudinal axis. Such a conduit is telescopically adjustable along a rectilinear length. A mechanism is included for discharging a selected volume of air away from the conduit. The air-discharging mechanism preferably includes a motor seated within the housing, a control switch electrically coupled to the motor and a fan directly connected to the motor. Such a fan is positioned intermediate of the motor and the proximal end portion of the conduit. The fan is selected from the group consisting of a preferred conical fan, an alternate embodiment turbo fan and a further embodiment squirrel cage fan respectively. The motor effectively propels the fan in such a manner that the fan draws in a selected volume of air through the slots of the housing and discharges the volume of air through the conduit.

In a final alternate embodiment, the air-discharging mechanism may further include a plurality of flaps suitably sized and shaped for covering the second and third paths such that the air is prevented from flowing therethrough. Each flap includes a hinge directly conjoined to one end portion of the dividers. Such flaps are independently adaptable between open and closed positions. Each flap further includes a plurality of tabs protruding outwardly from a perimeter thereof respectively. The side walls are provided with a plurality of slots wherein the tabs are removably positional into the slots for maintaining the flaps at the closed position during operating conditions.

A power supply source is electrically coupled to the air discharging mechanism. Such a power supply source is conveniently and advantageously contained within the housing and includes a rechargeable battery pack. The power supply source further includes first and second power cords selectively connectable to the battery pack so that the golfer can conveniently recharge the battery pack from a cigarette lighter or a electrical wall outlet respectively. A quick-release fastener is directly connected to the proximal end portion of the housing so that the golfer can advantageously and effectively attach the air-blower directly to a belt region of the golfer's pants.

In the final alternate embodiment, the device may further include a mechanism for splitting the volume of air along a plurality of unique paths such that the air flows substantially parallel to the putting green surface while the conduit is oriented at an oblique angle sloping distally and downwardly towards the putting green surface. Such an air-splitting mechanism preferably includes a nozzle that has an annular proximal end portion directly conjoined to the distal end portion of the conduit. The nozzle includes a plurality of linear dividers nested within the nozzle and has opposed end portions abutted directly against the proximal end portion of the nozzle and a distal end portion of the nozzle respectively. Such dividers split the air into three distinct and isolated paths wherein a first one of the paths is registered parallel to a longitudinal length of the dividers. Second and third ones of the paths diverge outwardly from the longitudinal axis wherein the air flows along a coextensive plane with the first path.

The nozzle may further have distally flaring side walls diverging away from the longitudinal axis such that the air flow covers a surface that has a width greater than a diameter of the conduit. Such a nozzle further has planar top and bottom walls extending parallel to each other and suitably spaced apart for defining a height less than the diameter of the conduit so that the air flows out of the nozzle along a concentrated path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
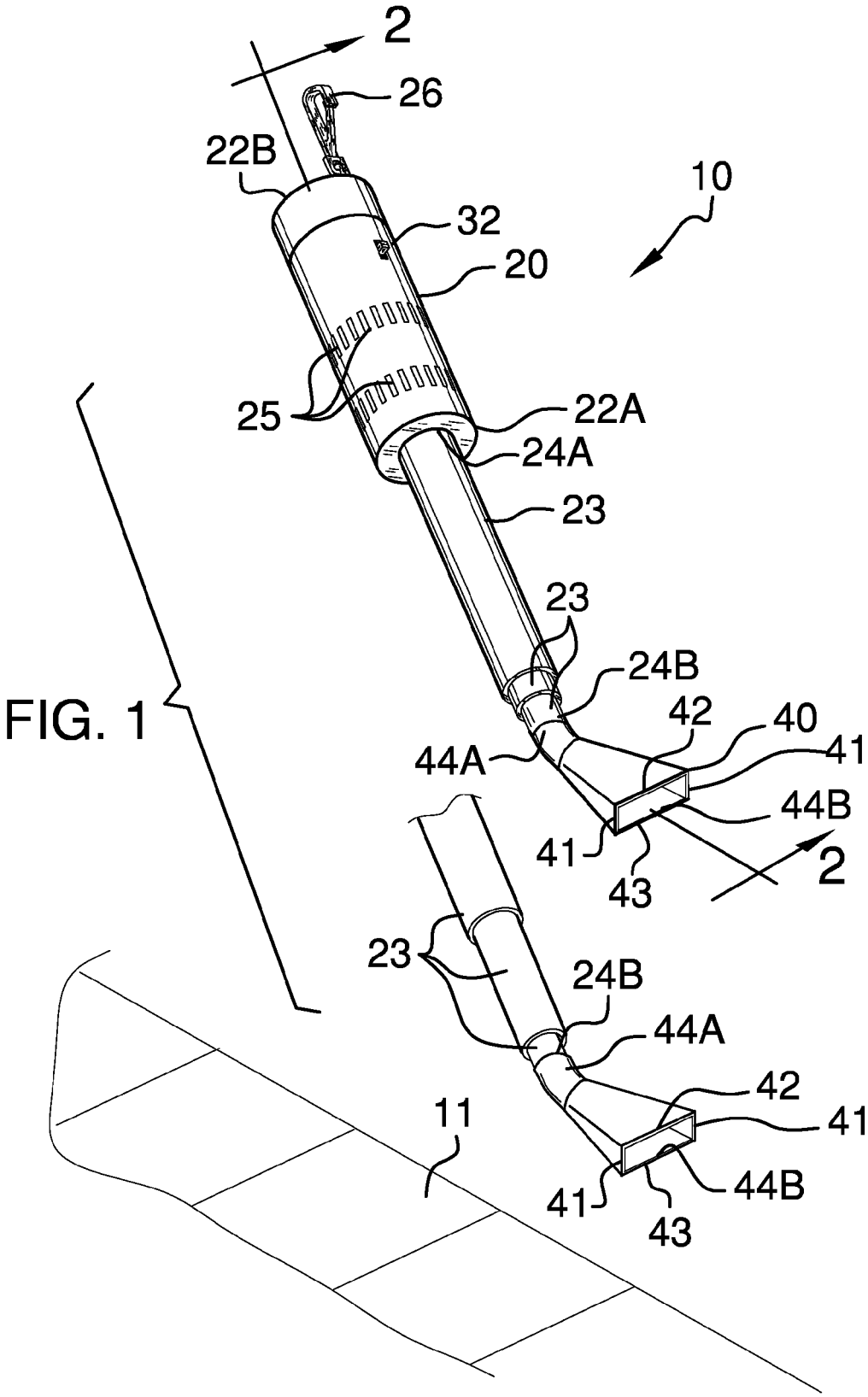
FIG. 1 is a perspective view showing a preferred embodiment of a portable air-blower for removing debris and the like from a putting green surface, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime, double prime and triple prime numbers refer to alternate embodiments of such elements.

The device of this invention is referred to generally in FIGS. 1-7 by the reference numeral 10 and is intended to provide a portable air-blower for removing debris and the like from a putting green surface. It should be understood that the device 10 may be used to remove debris from many different types of surfaces and should not be limited in use to only putting greens.

Referring initially to FIG. 1, the device 10 includes a cylindrical housing 20 formed from non-corrosive material and suitably sized for being conveniently transported during a round a golf. Of course, the housing 20 may be alternately sized and shaped, as is obvious to a person of ordinary skill in the art. Using non-corrosive material for the housing 20 construction is important so that same can repeatedly be employed in outdoor situations without the threat of being damaged by moist conditions. Such a housing 20 has a centrally registered longitudinal axis and a cavity 21 concentrically centered about the axis. The housing 20 further has an open distal end portion 22A in fluid communication with the cavity 21 and a closed proximal end portion 22B. The open distal end portion 22A includes a plurality of slots 25 equidistantly spaced about a circumference thereof that are vital for allowing air to enter the cavity 21

Figure 2:
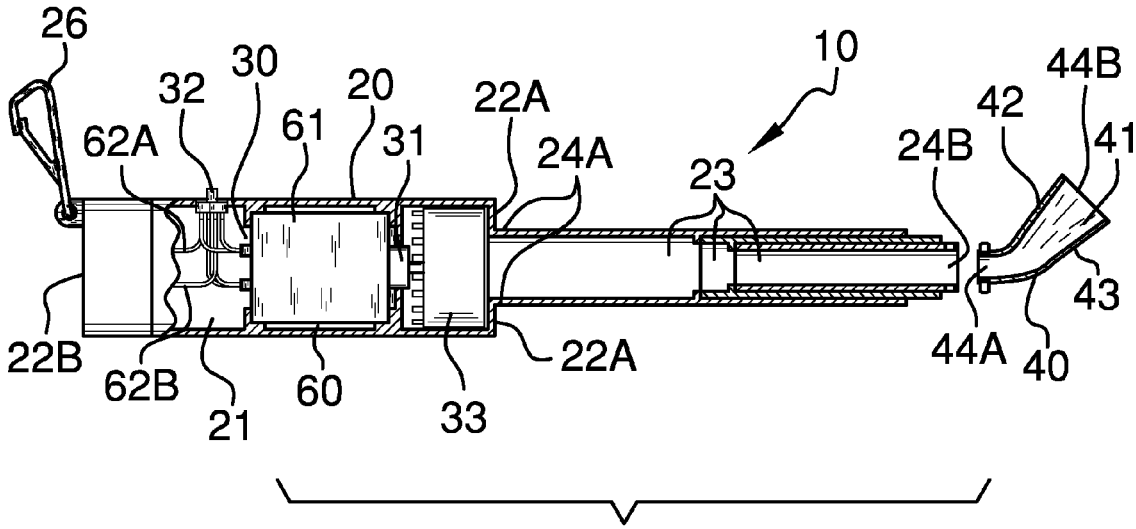
FIG. 2 is a cross-sectional view of the device shown in FIG. 1, taken along line 2-2.
Figure 4:
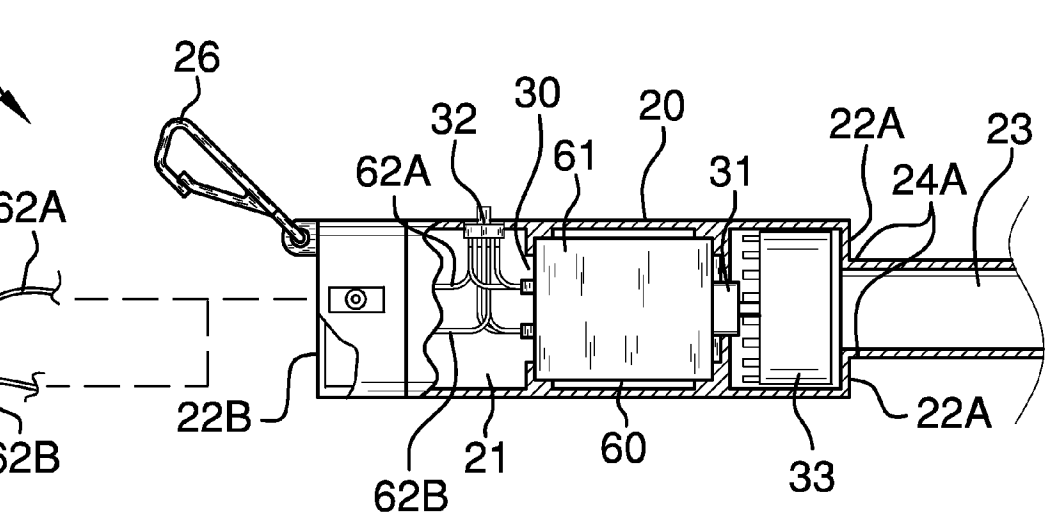
FIG. 4 is an enlarged cross-sectional view of the housing shown in FIG. 2, showing the conical fan housed therein.

Referring to FIGS. 1, 2 and 4, a tubular conduit 23 is directly conjoined, with no intervening elements, to the housing 20 and provided with proximal 24A and distal 24B end portions oppositely registered along the longitudinal axis. Such a conduit 23 is telescopically adjustable along a rectilinear length, which is critical and advantageous for allowing a golfer to employ the device 10 while still standing substantially straight. This allows those who might suffer from back pains and other muscle aches to remove impeding debris that they otherwise might not have been able to.

Figure 5:
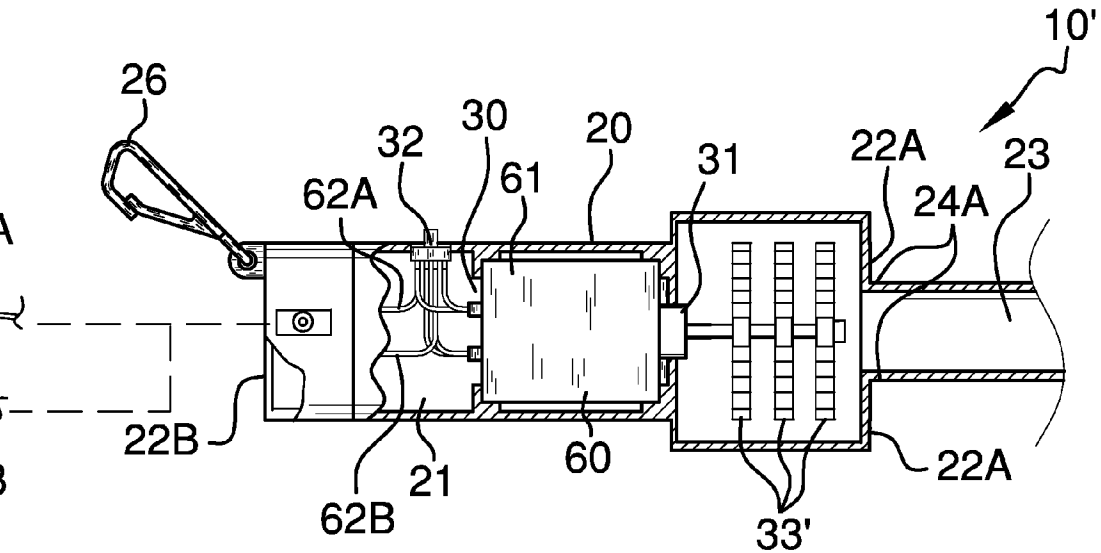
FIG. 5 is an enlarged cross-sectional view showing an alternate embodiment of the fan shown in FIG. 2, illustrating a turbo fan housed within the housing.

Referring to FIGS. 2, 4 and 5, a mechanism 30 is included for discharging a selected volume of air away from the conduit 23. The air-discharging mechanism 30 includes a motor 31 seated within the housing 20, a control switch 32 electrically coupled to the motor 31 and a fan 33 directly connected, with no intervening elements, to the motor 31. Such a fan 33 is positioned intermediate of the motor 31 and the proximal end portion 24A of the conduit 23. The fan 33 is selected from the group consisting of a preferred conical fan 33, an alternate embodiment 10' turbo fan 33' and a further embodiment 10" squirrel cage fan 33" respectively. The motor 31 is essential for effectively propelling the fan 33 in such a manner that the fan 33 effectively draws in a selected volume of air through the slots 25 of the housing 20 and discharges the volume of air through the conduit 23.

Figure 3:
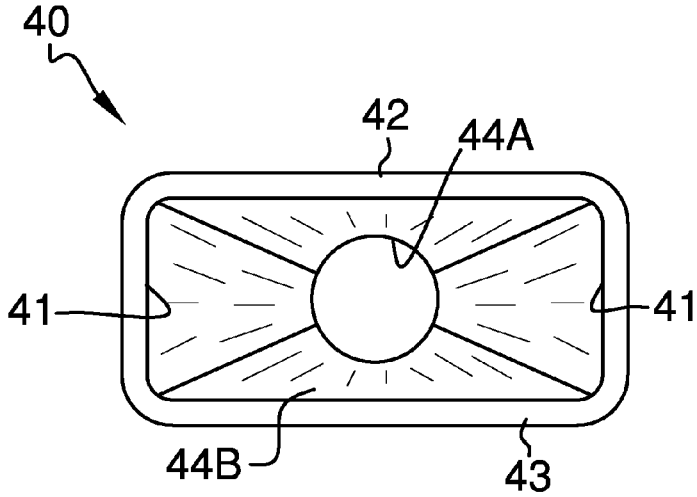
FIG. 3 is a front-elevational view of the nozzle shown in FIG. 1.

Referring to FIGS. 1 through 3, the device 10 also includes a nozzle 40 removably conjoined to the conduit 21 that has distally flaring side walls 41 diverging away from the longitudinal axis, which is essential such that the air flow effectively and advantageously covers a surface that has a width greater than a diameter of the conduit 21. The nozzle 40 thus allows for the rapid removal of more debris than is possible with the conduit 21 alone. Such a nozzle 40 further has planar top 42 and bottom 43 walls extending parallel to each other and suitably spaced apart for defining a height less than the diameter of the conduit 21 so that the air flows out of the nozzle 40 along a concentrated path and with an increased velocity that is crucial for lifting away debris on the putting surface 11.

Figure 7:
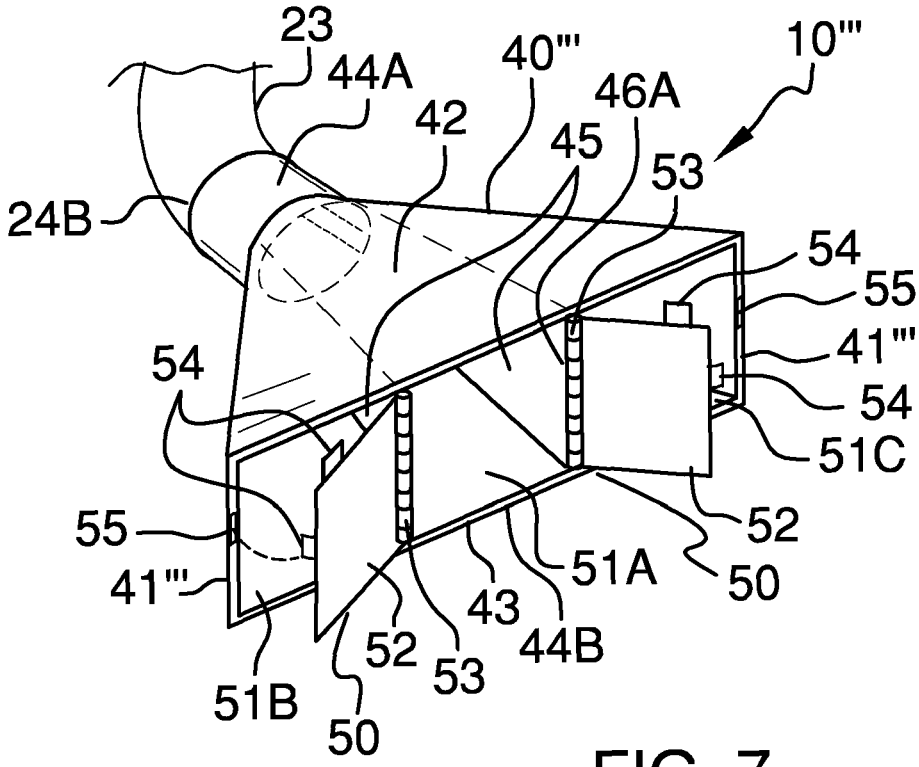
FIG. 7 is an enlarged perspective view showing yet another alternate embodiment of the nozzle shown in FIGS. 1, 2 and 3.
Figure 6:
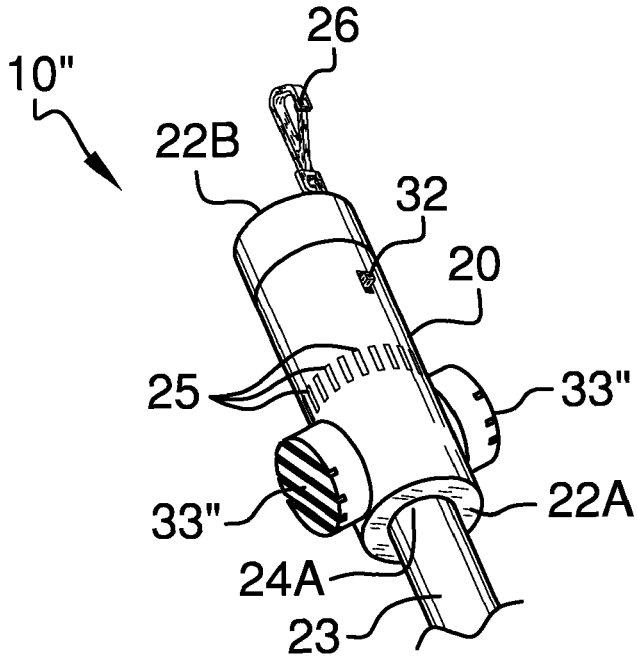
FIG. 6 is a perspective view showing a further embodiment of the fan shown in FIG. 2, illustrating a squirrel cage fan.

Referring to FIG. 7, in yet another alternate embodiment 10''', the device 10''' further includes a mechanism 50 for splitting the volume of air along a plurality of unique paths 51 such that the air flows substantially parallel to the putting green surface 11 while the conduit 21 is oriented at an oblique angle sloping distally and downwardly towards the putting green surface 11. Such an air-splitting mechanism 50 includes a nozzle 40''' that has an annular proximal end portion 44A directly conjoined, with no intervening elements, to the distal end portion 24B of the conduit 23. The nozzle 40''' includes a plurality of linear dividers 45 nested within the nozzle 40''' and has opposed end portions 46 abutted directly, with no intervening elements, against the proximal end portion 44A of the nozzle 40''' and a distal end portion 44B of the nozzle 40''' respectively. Such dividers 45 effectively split the air into three distinct and isolated paths 51 wherein a first one 51A of the paths 51 is registered parallel to a longitudinal length of the dividers 45. Second 51B and third 51C ones of the paths 51 diverge outwardly from the longitudinal axis wherein the air flows along a coextensive plane with the first path 51A.

Still referring to FIG. 7, in yet another alternate embodiment 10''', the air-discharging mechanism 50 further includes a plurality of flaps 52 suitably sized and shaped for covering the second 51B and third 51C paths such that the air is prevented from flowing therethrough. Each flap 52 includes a hinge 53 directly conjoined, with no intervening elements, to one end portion 46A of the dividers 45. Such flaps 52 are independently adaptable between open and closed positions, which is vital and advantageous for allowing a user to quickly and easily adjust and control the amount of airflow exiting the nozzle 40'''. Each flap 52 further includes a plurality of tabs 54 protruding outwardly from a perimeter thereof respectively. The side walls 41''' are provided with a plurality of slots 55 wherein the tabs 54 are removably positional into the slots 55, which is essential for advantageously and effectively maintaining the flaps 52 at the closed position during operating conditions.

Referring to FIGS. 2, 4 and 5, a power supply source 60 is electrically coupled to the air discharging mechanism 30. Such a power supply source 60 is conveniently and advantageously contained within the housing 20 and includes a6 volt rechargeable battery pack 61. Of course, other voltage power sources, such as a 12-volt power source and associated transformer, may be used, as is obvious to one having ordinary skill in the art. The power supply source 60 further includes first 62A and second 62B power cords selectively connectable to the battery pack 61, which is critical so that the golfer can conveniently recharge the battery pack 61 from a cigarette lighter or an electrical wall outlet respectively.

Referring to FIGS. 1, 2, 4, 5 and 6, a quick-release fastener 26 is directly connected, with no intervening elements, to the proximal end portion 22B of the housing 20 so that the golfer can advantageously and effectively attach the air-blower 10 directly to a belt region of the golfer's pants. Thus, the golfer can conveniently carry about the device 10 during an entire day of golfing without physically having to hold on thereto. Of course, the quick release fastener 26 may be used to attach the device 10 to alternate surfaces, such as the caddy's pants or the golf bag, as is obvious to a person of ordinary skill in the art.

While the invention has been described with respect to a certain specific embodiment, it will be appreciated that many modifications and changes may be made by those skilled in the art without departing from the spirit of the invention.

It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A light-weight air-blower for use on a putting green such that a golfer can remove sand, leaves, grass clippings and other loose impediments during putting procedures, said air-blower comprising:

a cylindrical housing formed from non-corrosive material and suitably sized for being transported during a round a golf, said housing having a centrally registered longitudinal axis and a cavity concentrically centered about the axis, said housing further having an open distal end portion in fluid communication with the cavity and a closed proximal end portion;

a tubular conduit directly conjoined to said housing and provided with proximal and distal end portions oppositely registered along the longitudinal axis, said conduit being telescopically adjustable along a rectilinear length;

means for discharging a selected volume of air away from said conduit;

a power supply source electrically coupled to said air discharging means, said power supply source being contained within said housing, wherein said power supply source comprises a 6-volt rechargeable battery pack, said power supply source further including first and second power cords selectively connectable to said battery pack so that the golfer can recharge said battery pack from a cigarette lighter or a electrical wall outlet respectively;

a quick-release fastener directly connected to said proximal end portion of said housing so that the golfer can effectively attach said air-blower directly to a belt region of the golfer's pants; and means for splitting the volume of air along a plurality of unique paths such that the air flows substantially parallel to the putting green surface while said conduit is oriented at an oblique angle sloping distally and downwardly towards the putting green surface;

wherein said air volume splitting means is directly conjoined to said distal end of said conduit and is further situated exterior of said conduit such that said air volume splitting means is located downstream of said distal end of said conduit;

wherein said plurality of unique paths are defined external of said distal end of said conduit and are located downstream of said distal end of said conduit;

wherein said air-splitting means comprises:

a nozzle having an annular proximal end portion directly conjoined to said distal end portion of said conduit, said nozzle including a plurality of linear dividers nested within said nozzle and having opposed end portions abutted directly against said proximal end portion of said nozzle and a distal end portion of said nozzle respectively, said dividers splitting the air into three distinct and isolated paths wherein a first one of said paths is registered parallel to a longitudinal length of said dividers, second and third ones of said paths diverging outwardly from the longitudinal axis wherein the air flows along a coextensive plane with said first path;

wherein said air-discharging means comprises:

a plurality of flaps suitably sized and shaped for covering said second and third paths such that the air is prevented from flowing therethrough, each said flaps including a hinge directly conjoined to one said end portions of said dividers, said flaps being independently adaptable between open and closed positions, each said flaps further including a plurality of tabs protruding outwardly from a perimeter thereof respectively; and wherein said nozzle further has distally flaring side walls being provided with a plurality of slots wherein said tabs are removably positional into the slots for maintaining said flaps at the closed position during operating conditions.

2. The device of claim 1, wherein said nozzle further side walls diverge away from the longitudinal axis such that the air flow covers a surface having a width greater than a diameter of said conduit, said nozzle further having planar top and bottom walls extending parallel to each other and suitably spaced apart for defining a height less than the diameter of said conduit so that the air flows out of said nozzle along a concentrated path.

3. The device of claim 1, wherein said air-discharging means comprises:

a motor seated within said housing;

a control switch electrically coupled to said motor; and a fan directly connected to said motor, said fan being positioned intermediate of said motor and said proximal end portion of said conduit, wherein said fan is selected from the group consisting of: a conical fan, a turbo fan and a squirrel cage fan respectively;

wherein said motor propels said fan in such a manner that said fan draws in a selected volume of air through the slots of said housing and discharges the volume of air through said conduit.

* * * * *